United States Patent [19]

Kuroyama et al.

[11] 4,089,157

[45] May 16, 1978

[54] DIGITAL CLOCK FOR MOTOR VEHICLES

[75] Inventors: Toshinobu Kuroyama, Kasugai; Hisashi Hirose, Toyota, both of Japan

[73] Assignee: Toyota Jidosha Kogyo K.K., Japan

[21] Appl. No.: 757,475

[22] Filed: Jan. 7, 1977

[30] Foreign Application Priority Data

Jun. 29, 1976 Japan ..... 51-76885

[51] Int. Cl.[2] ..... G04B 19/30; G04B 47/00; G04C 3/00

[52] U.S. Cl. ..... 58/50 R; 58/23 R; 58/152 R

[58] Field of Search ..... 58/23 R, 50 R, 152 R

[56] References Cited

U.S. PATENT DOCUMENTS 2,546,729 3/1951 De Miller ..... 58/23 R X
3,849,979 11/1974 Tanji ..... 58/50 R

FOREIGN PATENT DOCUMENTS 2,338,287 2/1975 Germany ..... 58/50 R

*Primary Examiner*—Stanley J. Witkowski
*Attorney, Agent, or Firm*—Koda and Androlia

[57] ABSTRACT

A motor vehicle digital display clock including a digital time display performed by fluorescent type display tubes provided in the passenger compartment of the motor vehicle, a driving means for generating time signals to be displayed on the display means, a selection switch means provided in the passenger compartment which generates a brightness signal and a brightness control circuit electrically coupled to the grid of the fluorescent type display tubes which controls the brightness of the fluorescent type display tubes by controlling the grid voltage in response to the brightness signal.

9 Claims, 3 Drawing Figures

DIGITAL CLOCK FOR MOTOR VEHICLES

BACKGROUND OF THE INVENTION

1. Field of the Invention

This invention relates to a digital display clock for motor vehicles and in particular to digital type clock for motor vehicles which utilize a fluorescent type tube as the time display.

2. Description of the Prior Art

Since one must be able to read the time quickly and easily while driving a motor vehicle, a digital type display clock finds particular utility. Among the various elements available for the digital display, such as luminescent diodes, liquid crystals, fluorescent display tubes, etc., the fluorescent display tube has very excellent characteristics such as strong brightness for easy reading, low voltage operation, a greenish-blue display which is easy to read, freedom of choice of letter size, long life and high mechanical strength.

In a motor vehicle environment, an important requirement for the digital display clock is that its brightness must be adjustable according to the level of the ambient light. A digital display clock utilized in a motor vehicle is used at various times of the day under a variety of light ambient conditions which depend upon the weather and the season. Furthermore, the display must be easily read under all of the conditions. In other words, a time display which is hardly readable under strong daylight conditions but perfectly readable in darkness at night is insufficient and conversely a bright display which is easily read in daylight is dazzling at night and also insufficient. Furthermore, since the motor vehicle is subjected to the direct outdoor light and darkness, the level of the brightness of the clock display is even more important. In particular, a dazzling time display at night may adversely affect the driver's visibility, and therefore maneuverability. Consequently, the brightness of the clock display must be freely adjustable.

A fluorescent type display tube is ideal for motor vehicle clocks because the light intensity can be easily adjusted by changing its anode voltage, grid voltage or duty cycle. In motor vehicle clocks with digital displays using fluorescent tubes, a circuit for adjustment of the anode voltage has been provided in a clock system of the prior art. Such a prior art system suffers from several defects. First of all, such a circuit for adjustment of the brightness of the fluorescent tube is very complex. Furthermore, the prior art circuit in which the display circuit and the circuit for brightness control are combined into one, the light control circuit must be altered whenever a change is made in the display control circuit.

SUMMARY OF THE INVENTION

Accordingly, it is the general object of the present invention to provide a digital display clock for a motor vehicle in which the display brightness can be adjusted by means of a simple circuit structure.

It is another object of the present invention to provide a digital display clock for a motor vehicle wherein the means for controlling the brightness of the display is independent of the means for generating time signals.

In keeping with the principles of the present invention, the objects are accomplished with a unique digital display clock for a motor vehicle including a digital time display element performed by fluorescent type display tubes provided in the passenger compartment of the motor vehicle, a driving means for generating time signals to be displayed on the fluorescent type display tubes, a selection switch means provided in the passenger compartment which generates a brightness signal and a brightness control circuit electrically coupled to a grid of the fluorescent type display tubes which controls the level of the brightness of the fluorescent type display tube by controlling the voltage applied to the grids of the fluorescent type display tubes.

BRIEF DESCRIPTION OF THE DRAWINGS

The above mentioned and other features and objects of the present invention will become more apparent by reference to the following description taken in conjunction with the accompanying drawings, wherein like referenced numerals denote like elements, and in which.

DETAILED DESCRIPTION OF THE INVENTION

Figure 1:
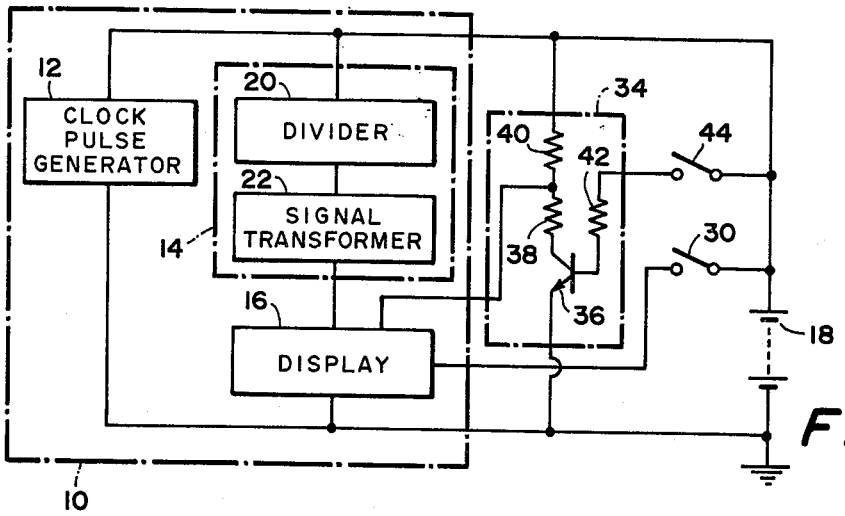
FIG. 1 is a circuit diagram of a digital type clock for motor vehicles in accordance with the teachings of the present invention.
Figure 2:
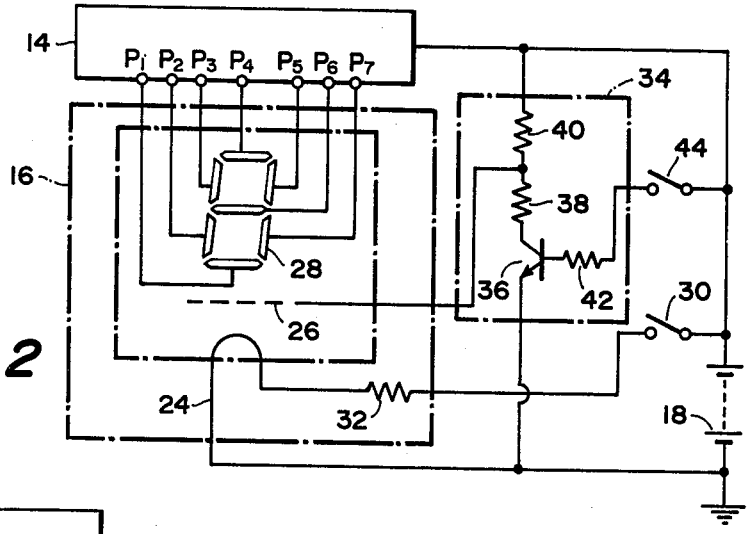
FIG. 2 is a more detailed circuit diagram of the circuit of FIG. 1.

Referring more particularly to the drawings, shown in FIGS. 1 and 2 is a basic embodiment of a digital clock for a motor vehicle in accordance with the teachings of the present invention. FIG. 1 is an overall layout of the clock circuit and FIG. 2 is an expanded view of the driving section of the fluorescent display tube. In FIG. 1, the clock circuit 10 includes a clock pulse generator circuit 12, a driving section 14 and a time display section 16 for which the automobile battery 18 serves as a source of power. The clock pulse generator circuit 12 normally consists of a quartz crystal oscillator system with temperature compensation which delivers a clock pulse signal with an extremely stable frequency to the driving section 14. It goes without saying that the invention can be embodied by a clock pulse generator circuit 12 which is made from a basic oscillation element other than a quartz crystal, for example, a tuning fork or other mechanical oscillator.

The driving section 14 is a circuit where the signals from the time display are synthesized from the clock pulse signal that comes from the clock pulse generator circuit 12 and includes a divider circuit 20 and a transformer circuit 22 for the display 16. The high frequency time signals from the clock pulse generator circuit 12 are transformed into signals with frequencies for hours, minutes and seconds in the divider circuit 20 which would preferably be multistage multivibrator circuit. The signal transformer circuit 22 that transforms the output of the divider circuit 20 into hours, minutes and seconds and other signals that are suitable as display signals, is composed of a matrix circuit that generates signals for each display element of the fluorescent type display tube. The outputs of the signal transformer circuit 22 are fed into their respective fluorescent display tubes located in the time display section 16 for displaying the time. The pulse generator circuit 12, divider circuit 20 and signal transformer circuit 22 are well known in the art.

Referring to FIG. 2, shown therein is an arbitrarily chosen time display element in the time display section 16 in which a single numeral is composed of a seven-element fluorescent display tube. The fluorescent display tube consists of a filament cathode 24 that emits thermal electrons, a grid 26 which accelerates and controls the thermal electrons from the cathode 24 and a seven-element segment type anode 28 made of fluorescent material for omission of light when it is excited by colliding thermal electrons. The seven output terminals $P_1 - P_7$ of the driving section 14 are connected with each of the segment type anodes 28 and the anode voltage is applied for the appropriate anode element selected by the signal transformer circuit 22

The clock circuit 10 of the motor vehicle clock with digital display by fluorescent type display tubes is composed of the above mentioned circuits and installed in the passenger compartment of the motor vehicle. Since electrical power for the clock pulse generator circuit 12 and the driving section 14 of the clock circuit 10 is always supplied by battery 18, the correct time is always maintained by the system. However, since the power is fed to the time display section 16 via switch 30, no time is displayed on the fluorescent tube when the switch 30 is in the "off" position although the correct time is being internally maintained by clock pulse generator circuit 12 and driving section 14. Accordingly, a saving of electric current consumption can be achieved by turning off the display section 16 when it is not needed. To achieve this function, the switch 30 may be coordinated or combined with either the ignition switch or an on/off type accessory switch which is controlled by the ignition key of the automobile. It is preferable that the switch 30 be connected with the cathode 24 by resistor 32 as shown in FIG. 2. Therefore, no heating current passes from the battery 18 into the cathode 24 as long as the switch 30 is in the "off" position and hence, no electron emission from the cathode takes place and the display function of the fluorescent display tube is thus blocked.

The embodiment of FIG. 2 is further characterized by a brightness control circuit 34 which is coupled to the grid 26 of the fluorescent type display tube of the time display section 16. The brightness control circuit 34 includes a switching transistor 36 having its collector coupled to the positive terminal of the battery 18 via dividing resistors 38 and 40. Furthermore, the emitter of transistor 36 is coupled to the negative terminal of the battery 18. The junction point between the dividing resistors 38 and 40 is connected with the grid 26 of the fluorescent type display tube. The base of the transistor 36 is connected with the positive terminal of the battery 18 via resistor 42 and selector switch 44. The selector switch 44 is used for the brightness selection such that the light intensity of the motor vehicle clock display can be altered by operating the switch "ON" and "OFF" in the passenger compartment of the motor vehicle.

In operation, if one desires that the brightness of the motor vehicle clock be set high for daytime driving, the selection switch 44 is placed in the "OFF" position. When the selector switch 44 is placed in the "OFF" position, no base current is supplied to the transistor 36 and the transistor 36 together with the brightness control circuit 34 assumes an "OFF" state. Consequently, the grid 26 of the fluorescent type display tube is coupled directly to the positive terminal of the battery 18 via resistor 40. Since the grid current of the fluorescent type display tube is extremely low, the grid voltage becomes approximately equal to the source voltage of battery 18 and the brightness of each of the segments of anode 28 is thus made high.

If during night driving conditions, one desires to turn down the brightness of the display, the brightness selector switch 44 is placed in the "ON" condition. In this position, base current is fed into transistor 36 of brightness control circuit 34 and the transistor 36 assumes the "ON" state. As a result, current from battery 18 flows through dividing resistors 38 and 40 of the brightness control circuit 34 thereby dividing the voltage by the ratio of the dividing resistors 38 and 40 and supplying a lower grid voltage to the grid 26 of the fluorescent type display tube. Consequently, the acceleration of electrons emitted from the filament cathode 24 towards each segment of the anode 28 is lowered and the brightness of the fluorescent type display tube is accordingly decreased.

As is evident from FIGS. 1 and 2, the brightness control circuit 34 is constructed separately from the clock circuit 10 and thus it is possible to alter the brightness of the time display by simply connecting the brightness control circuit 34 together with switch 44 to the fluorescent type display tube of the clock circuit 19 without affecting the operation of the clock pulse generator circuit 12 and the driving section 14. This presents a very practical advantage in that it is possible to apply the same brightness control circuit 34 together with the switch 44 to more than one kind of clock circuit 10 having different types of clock pulse generator circuit 12 and driving section 14.

Figure 3:
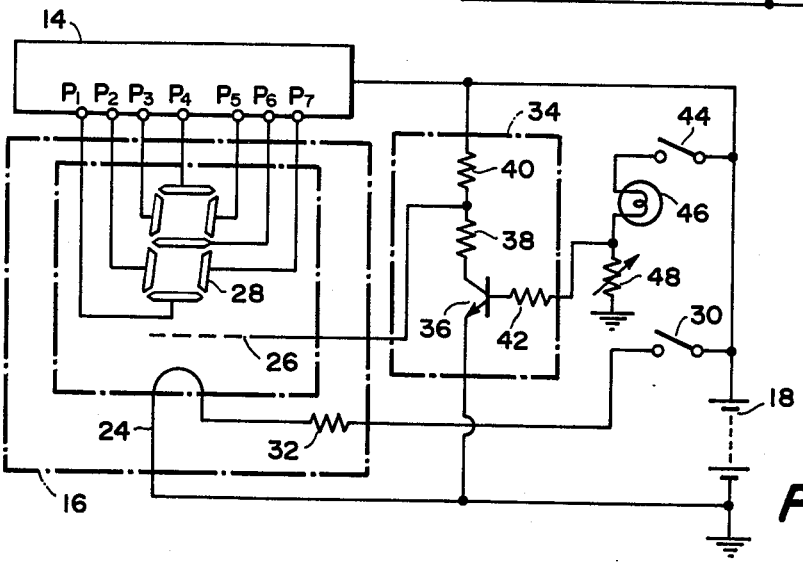
FIG. 3 is a circuit diagram of the main portion of a second embodiment of a digital type display clock for motor vehicles in accordance with the teachings of the present invention.

Referring to FIG. 3, shown therein is a second embodiment of a digital display clock in accordance with the teachings of the present invention. Since the embodiment of FIG. 3 is similar to the embodiment of FIG. 2 in many respects, common elements in FIG. 3 are given like numerals and an explanation of their interconnection and operation will be omitted.

The second embodiment of FIG. 3 is characterized by the coordination of the brightness selector switch system with the instrument lamp switch of the motor vehicle. In FIG. 3, the switch 44 also serves as a switch for the instrument lamps. One end of switch 44 is connected with the positive terminal battery 18 while the other end is connected to the negative terminal of battery 18 via the instrument illumination lamp 46 and a variable resistor 48. The mid junction point between the lamp 46 and the variable resistor 48 is connected with one end of resistor 42 and the other end of resistor 42 is connected with the base of transistor 36 of the brightness control circuit 34.

In this second embodiment, the light level of the automobile clock display is decreased simultaneously with the decrease of the ambient light level when it becomes dusk. Generally, an instrument illumination system is coupled with such external lamps as the headlamps or taillamps and these are simultaneously activated by an "ON" action of the switch 44 which turns on the motor vehicle lamps by supplying current from the battery 18 and also turns on the instrument illumination lamp 46 through switch 44. When this occurs, base current is supplied to transistor 36 of the brightness control switch circuit 34 thereby causing transistor 36 to be in the "ON" state. When transistor 36 assumes the "ON" state the voltage applied to grid 26 of fluorescent type display tube is lowered thereby decreasing the brightness of the time display.

The variable resistor 48 which is connected in a series with the instrument illumination lamp 46 is convenient for adjusting the light level of the instrument illumination lamp 46. With an increase in the value of the resistance of the variable resistor 48, the potential at the mid-junction point between the lamp 46 and the resistor 48 increases thereby decreasing the light level of the instrument illumination lamp 46. When this occurs, the conductivity of the transistor 36 changes simultaneously and the light level of the time display is altered accordingly. In other words, with an increase in the value of the resistance of the variable resistor 48, the base potential of the transistor 36 increases and as a consequence, the collector voltage will decrease and the light level of the time display decreases as a result of the drop in grid voltage applied to the grid 26.

This second embodiment enables a finer adjustment of the brightness of the time display depending on the ambient lamp conditions.

According to the preceding, the invention provides a brightness control system which is suitable for any motor vehicle digital clock utilizing fluorescent type display tubes, regardless of the type of circuit structure utilized by the clock by separating the brightness selecting circuitry from the clock circuitry. Separation of the brightness selection circuitry from the clock circuitry is accompanied by numerous advantages in that the brightness selection circuitry cannot only be utilized with any type of clock circuitry but also the readability of the digital display can be improved for all ambient light conditions without causing a deleterious affect upon the driveability and safety of the motor vehicle. Furthermore, it should be apparent that the aforedescribed digital clock can be used in any motor vehicle such as an automobile, truck, etc.

In all cases, it is understood that the above described embodiments are merely illustrative of but a few of the many possible specific embodiments which represent the applications of the principles of the present invention. Numerous and varied other arrangements can be readily devised in accordance with these principles by those skilled in the art without departing from the spirit and scope of the invention.

I claim:

1. A motor vehicle digital display clock comprising:

at least one fluorescent type digital display tube for displaying the time provided in the passenger compartment of the motor vehicle, said fluorescent type tube including a grid, a cathode and anodes;

a means for generating time signals to be displayed on said fluorescent tube;

a selection switch means provided in said passenger compartment which determines the brightness of said fluorescent type tube; and a brightness control circuit coupled to said grid of said fluorescent type display tube which controls the brightness of said fluorescent type digital display tube in response to said selection switch means by controlling a voltage applied to said grid of said fluorescent type display tube.

2. A motor vehicle digital display clock according to claim 1 wherein said selector switch means is a switch which operates in coordination with a switch for turning ON an instrument illumination lamp of said motor vehicle.

3. A motor vehicle digital display clock according to claim 1 wherein said brightness control circuit is electrically coupled to a light level control means for an instrument illumination lamp of said motor vehicle such that simultaneous changes of instrument illumination light level and brightness of the fluorescent type display tube occur.

4. A motor vehicle digital display clock according to claim 1 wherein said brightness control circuit comprises a first resistor coupled to said grid of said fluorescent type digital display tube for applying a grid voltage to said grid, a switching element controlled to on or off by said selection switch means, and a second resistor coupled to the mid junction point between said first resistor and said switching element so as to constitute a voltage dividing circuit with said first resistor for applying a lower grid voltage to said grid when said switching element is controlled to on state.

5. A motor vehicle digital display clock according to claim 4 wherein said switching element comprises a transistor having a base coupled to said selection switch means and a collector coupled to said second resistor.

6. A motor vehicle digital display clock according to claim 4 wherein said brightness control circuit includes a control means for variably controlling the voltage supplied to said grid.

7. A motor vehicle digital display clock according to claim 6 wherein said control means comprises a variable resistor coupled to said base of said transistor.

8. A motor vehicle digital display clock according to claim 7 wherein:

said selection switch means comprises an instrument lamp switch connected in series with an instrument illumination lamp and with a variable resistor which serves to control the brightness of said instrument illumination lamp; and said switching element is connected to the mid junction point between said instrument illumination lamp and said variable resistor which also serves to control the voltage supplied to said grid of said fluorescent type display tube.

9. A motor vehicle digital display clock according to claim 1 wherein:

said brightness control circuit comprises a first resistor to supply a grid voltage to said grid of said fluorescent type display tube, a NPN transistor controlled on or off states by said selection switch means, and a second resistor connected in series with said first resistor to constitute a voltage dividing circuit for decreasing a grid voltage when said transistor is turned on state;

said selection switch means comprises an instrument lamp switch connected in series with an instrument illumination lamp and with a variable resistor; and the base of said NPN transistor connected with the mid junction point between said instrument illumination lamp and said variable resistor, with a variation of the resistance of said variable resistor the brightness of said instrument illumination lamp is controlled and the voltage of said grid is simultaneously varied to control the brightness of said fluorescent type display tube.

* * * * *